US007477855B2

(12) United States Patent
Chae et al.

(10) Patent No.: US 7,477,855 B2
(45) Date of Patent: Jan. 13, 2009

(54) METHOD OF PREVENTING OVERHEATING OF FUSER ASSEMBLY AND APPARATUS USING THE SAME

(75) Inventors: Su-kyoung Chae, Seoul (KR); Cheol-ju Yang, Suwon-si (KR); Jun-bae Jeon, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 328 days.

(21) Appl. No.: 11/137,400

(22) Filed: May 26, 2005

(65) Prior Publication Data

US 2006/0018675 A1 Jan. 26, 2006

(30) Foreign Application Priority Data

Jul. 20, 2004 (KR) ..... 10-2004-0056420

(51) Int. Cl.
*G03G 15/20* (2006.01)

(52) U.S. Cl. ..... 399/33; 399/68

(58) Field of Classification Search ..... 399/33, 399/68, 69, 320, 322; 219/216; 430/124.3
See application file for complete search history.

(56) References Cited

U.S. PATENT DOCUMENTS

| | | | | |
|---|---|---|---|---|
| 4,078,166 | A * | 3/1978 | Kitamura et al. | 219/216 |
| 5,966,556 | A * | 10/1999 | Nakagawa et al. | 399/18 |
| 6,728,497 | B2 * | 4/2004 | Masuda et al. | 399/45 |
| 7,079,782 | B2 * | 7/2006 | Sone et al. | 399/69 |
| 2004/0042810 | A1 | 3/2004 | Cho | |

FOREIGN PATENT DOCUMENTS

| | | | |
|---|---|---|---|
| JP | 01019382 | A * | 1/1989 |
| JP | 08234620 | A * | 9/1996 |
| JP | 10010916 | A * | 1/1998 |
| JP | 2000-296970 | | 10/2000 |
| JP | 2001-255782 | | 9/2001 |
| JP | 2001282039 | A * | 10/2001 |
| JP | 2002-351243 | | 12/2002 |
| JP | 2003-081510 | | 3/2003 |
| JP | 2003076189 | A * | 3/2003 |
| JP | 2003-156953 | | 5/2003 |
| JP | 2003173103 | A * | 6/2003 |
| KR | P1998-061433 | | 11/1998 |
| KR | 1020010021041 | | 3/2001 |

* cited by examiner

*Primary Examiner*—Robert Beatty
(74) *Attorney, Agent, or Firm*—Roylance, Abrams, Berdo & Goodman, L.L.P.

(57) ABSTRACT

Disclosed are a method of preventing overheating of a fuser assembly and an apparatus using the same. The method of preventing overheating of a fuser assembly includes inspecting whether a temperature of a fuser assembly is higher than a predetermined temperature. If the temperature of the fuser assembly is higher than the predetermined temperature it is determined whether there is a print command. A print sheet is passed through the fuser assembly, and conveyed to a predetermined location when there is no print command. The temperature is again inspected if there is no print command. If the temperature is lower than the predetermined temperature it is determined whether a predetermined time has lapsed. The temperature is again inspected if the predetermined time did not lapse.

16 Claims, 2 Drawing Sheets

METHOD OF PREVENTING OVERHEATING OF FUSER ASSEMBLY AND APPARATUS USING THE SAME

CROSS REFERENCE TO RELATED APPLICATION

This application claims the benefit under 35 U.S.C. § 119 (a) of Korean Patent Application No. 10-2004-0056420, filed on Jul. 20, 2004, in the Korean Intellectual Property Office, the entire disclosure of which is hereby incorporated by reference.

BACKGROUND OF THE INVENTION

1. Field of the Invention

The present invention relates to an image forming apparatus, such as a printer and an all-in-one imaging machine. More particularly, the present invention relates to a method of preventing overheating of a fuser assembly for fixing an image transferred to a print sheet in the image forming apparatus and an apparatus using the same.

2. Description of Related Art

Typically, a fuser assembly includes a heating roller and a press roller, and is an apparatus that passes a print sheet having a toner thereon through space between the heating roller and the press roller to permanently fix the toner onto the print sheet by heat and pressure. The heating roller generates heat of about 180° C. The press roller is composed of a silicon rubber. An exemplary press roller melts the toner particles stuck onto the print sheet by heat while applying a strong pressure toward the heating roller.

According to conventional art, a thick rubber layer is used for the heating roller and the press roller of the fuser assembly to guarantee fixing the toner particles to the print sheet. The response time is very long and thus the temperature of the fuser assembly rises for a while even when the heat supplied according to a temperature control is switched off. In particular, right after printing the print sheet functioning as a medium taking the heat from the fuser assembly does not pass through the fuser assembly such that the temperature of the fuser assembly also shows a sudden rise for a while even when the heat supplied according to a temperature control is switched off. Therefore, the fuser assembly may be easily melted or deformed by the sudden rise of the temperature of the fuser assembly.

Accordingly, a need exists for an image forming apparatus having a fuser assembly that is substantially prevented from overheating.

SUMMARY OF THE INVENTION

The present invention provides a method for preventing overheating of a fuser assembly to prevent deformation of the fuser assembly by forcing a print sheet to pass through the fuser assembly after a printing.

The present invention further provides an apparatus for preventing overheating of a fuser assembly in which the fuser assembly is prevented from being deformed by forcing a print sheet to pass through the fuser assembly after a printing.

According to an aspect of the present invention, there is provided a method of preventing overheating of a fuser assembly including inspecting whether a temperature of a fuser assembly is higher than a predetermined temperature. If the temperature of the fuser assembly is higher than the predetermined temperature it is determined whether there is a print command. A print sheet is passed through the fuser assembly, conveyed to a predetermined location, and again inspecting the temperature of the fuser assembly if there is no print command. If the temperature is lower than the predetermined temperature it is determined whether a predetermined time has lapsed. The temperature is inspected if the predetermined time does not lapse.

According to another aspect of the present invention, an apparatus for preventing overheating of a fuser assembly includes a fuser assembly temperature inspection unit for inspecting a temperature of the fuser assembly to determine if the temperature of the fuser assembly is higher than a predetermined temperature. A print command determining unit for determining whether there is a print command in response to an inspection result from the fuser assembly temperature inspection unit. A print sheet convey processing unit for conveying the print sheet to a predetermined location after passing the print sheet through the fuser assembly in response to a determination result from the print command determining unit. A time lapse determining unit for determining whether a predetermined time lapses in response to the inspection result from the fuser assembly temperature inspection unit.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Hereinafter, exemplary embodiments of a method for preventing overheating of a fuser assembly according to the present invention will be described in detail with reference to the accompanying drawings.

Figure 1:
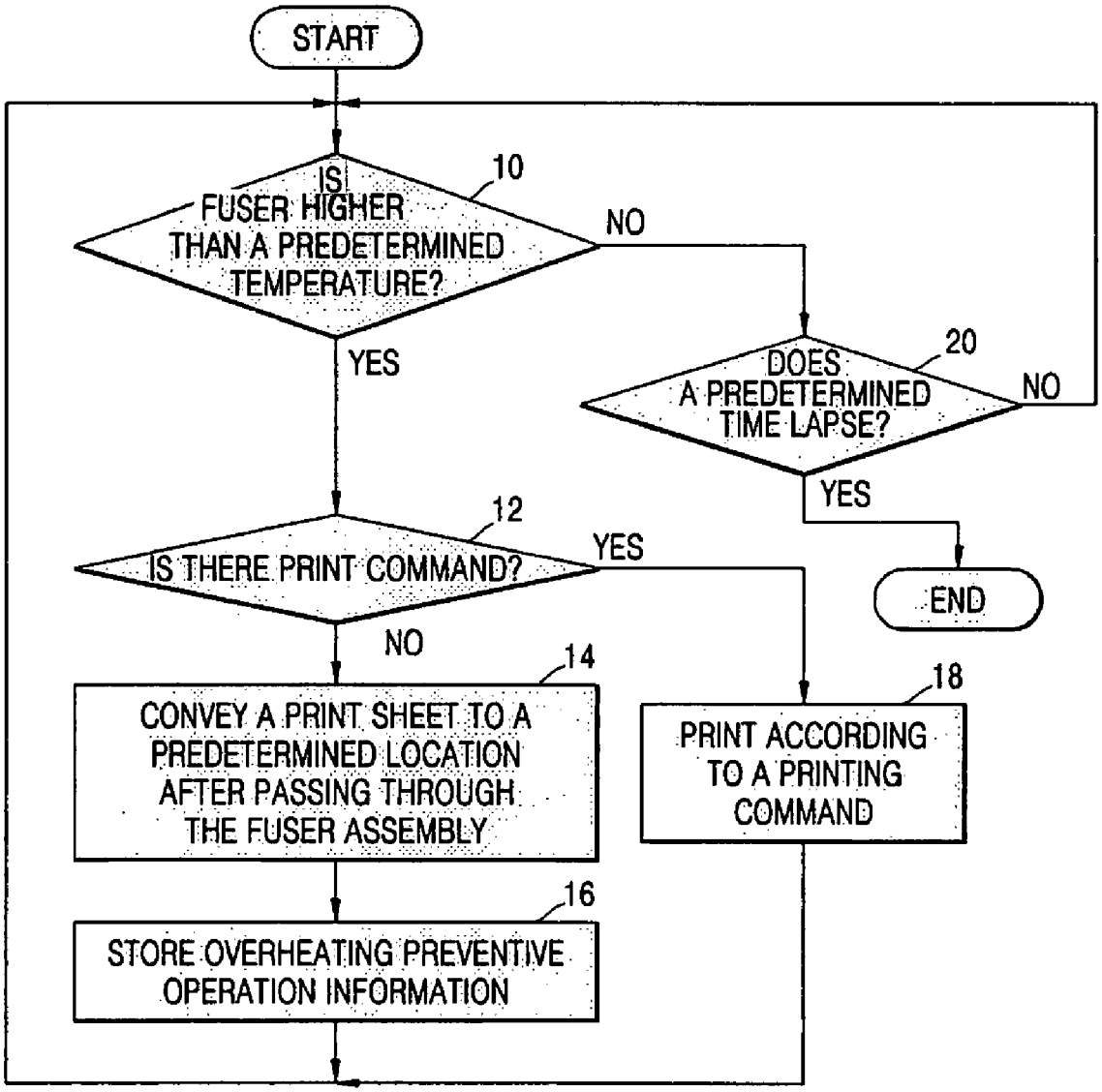
FIG. 1 is a flowchart of a method of preventing overheating of a fuser assembly according to an exemplary embodiment of the present invention.

FIG. 1 shows a flowchart describing a method of preventing overheating of a fuser assembly according to an exemplary embodiment of the present invention. The method according to an exemplary embodiment of the present invention includes operations 10 through 20 in which a temperature of a fuser assembly is detected to determine whether the detected temperature is higher than a predetermined temperature and then a print sheet is passed through the fuser assembly to lower the high temperature.

First, the temperature of the fuser assembly is detected to determine whether the detected temperature is higher than a predetermined temperature (operation 10). The predetermined temperature is set to a value at which the fuser assembly may be deformed.

If the detected temperature is higher than the predetermined temperature, it is determined whether there is a print command (operation 12). That is, when the fuser assembly is overheated by the temperature higher than the predetermined temperature, it is determined whether there is a print command for a substantial printing.

If there is no print command, a print sheet passes through the fuser assembly and then is conveyed to a predetermined location. Then, the process is returned to operation 10 (operation 14). If the fuser assembly remains in the overheated state, since the fuse assembly may be deformed, the temperature of the fuser assembly must be lowered. Therefore, in operation 14, a print sheet is provided to pass through the fuser assembly to lower the high temperature. By passing the print sheet through the fuser assembly, the print sheet takes the heat away from the fuser assembly.

Then, the print sheet that has passed through the fuser assembly is conveyed to a predetermined location. There may be two exemplary ways to convey the print sheet to the predetermined location. In the first method, the print sheet that has passed through the fuser assembly is conveyed to a sheet-feeding cassette. Even if the print sheet has passed through the fuser assembly, since the print sheet does not have printing data to be transferred and fixed thereon, the print sheet is collected in a sheet-feeding cassette, thereby allowing the print sheet to be reused for a next printing according to a print command.

In the second method, the print sheet that has passed through the fuser assembly to lower the temperature is conveyed to a sheet-feeding standby location for a back-side printing in a duplex printing mode. In other words, the print sheet that has passed through the fuser assembly to lower the temperature is conveyed to the sheet-feeding standby location to reuse it for a back-side printing according to a duplex printing process.

Finally, according to an exemplary embodiment of the present invention, since the print sheet that has passed through the fuser assembly to lower the temperature is conveyed to a predetermined location to reuse it, a print sheet that has not experienced a substantial printing is not allowed to be discharged outside the image forming apparatus.

After operation 14, information is stored that indicates the overheating preventive operation has been performed to lower the temperature (operation 16). According to a conventional art, if the print sheet is not discharged outside the image forming apparatus after passing through the fuser assembly to lower the temperature, the image forming apparatus recognizes it as a print sheet jamming during the printing process, and then an error message is displayed. However, according to an exemplary embodiment of the present invention, to prevent such an erroneous indication, if it is detected that the print sheet has passed through the fuser assembly to lower the temperature after operation 14 but has not been discharged, overheating preventive operation information is stored indicating that the overheating preventive operation has been performed to lower the temperature. The overheating preventive operation information indicating the print sheet has passed through the fuser assembly but does not correspond to a paper jamming is used to prevent an error message from being displayed in advance.

On the one hand, if there is a print command for a substantial printing in operation 12, the printing is performed according to the print command and the procedure is returned to operation 10 (operation 18). If there is a print command, the temperature of the fuser assembly must be maintained at least at a temperature for fusing toner to the print sheet even when the fuser assembly is overheated. Therefore, there is no need to lower the temperature of the fuser assembly. Furthermore, when the print sheet having a toner transferred thereon passes through the fuser assembly for a substantial printing, the temperature of the fuser assembly may be lowered to some extent.

On the other hand, if the temperature of the fuser assembly is not higher than the predetermined temperature in operation 10, it is determined whether a predetermined amount of time has lapsed (operation 20).

If the predetermined time does not lapse, the procedure is returned to operation 10 and then the above procedures are performed again. On the other hand, if the predetermined time has lapsed, then the above procedure is terminated, as shown in FIG. 1.

Preferably, the method of preventing overheating of a fuser assembly according to the present invention is performed right after finishing the substantial printing. It is known that the temperature of the fuser assembly tends to constantly rise right after finishing the substantial printing. Therefore, by performing the method of preventing overheating of a fuser assembly according to an exemplary embodiment of the present invention, it is possible to prevent the fuser assembly from being deformed by the rising temperature.

Hereinafter, a device for preventing overheating of a fuser assembly according to exemplary embodiments of the present invention are described in detail with reference to the accompanying drawings.

Figure 2:
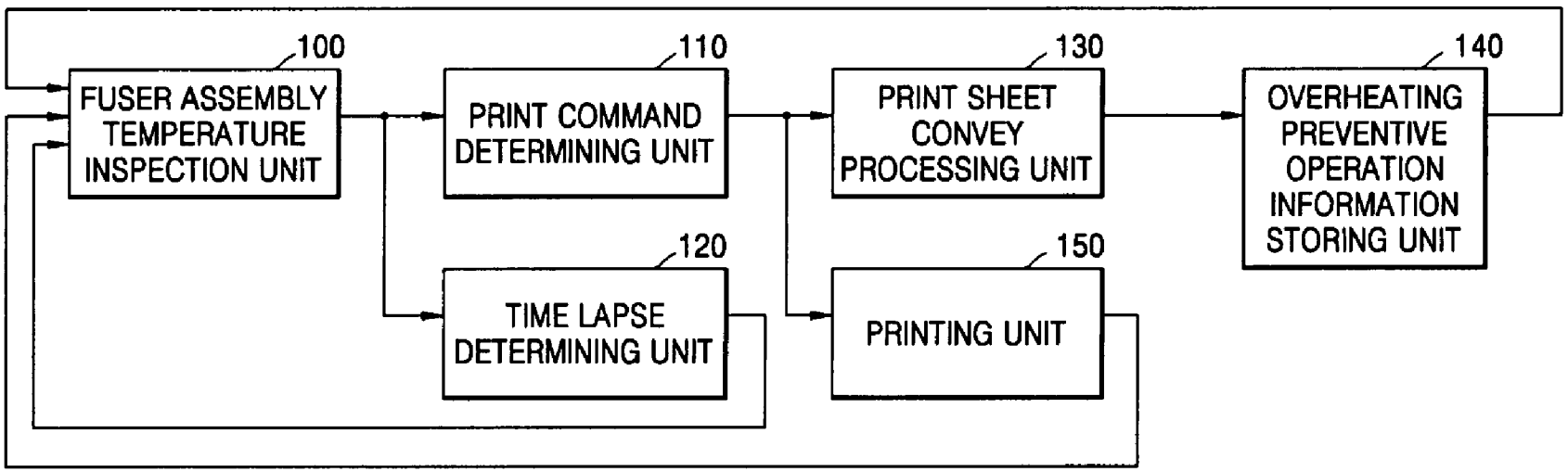
FIG. 2 is a block diagram illustrating a device for preventing overheating of a fuser assembly according to an exemplary embodiment of the present invention.

FIG. 2 is a block diagram illustrating a device for preventing overheating of a fuser assembly according to an exemplary embodiment of the present invention. The device according to the present invention includes a fuser assembly temperature inspection unit 100, a print command determining unit 110, a time lapse determining unit 120, a print sheet convey processing unit 130, an overheating preventive operation information storing unit 140, and a printing unit 150.

The fuser assembly temperature inspection unit 100 inspects the temperature of the fuser assembly (not shown in the drawing) to determine whether the temperature is higher than a predetermined temperature and outputs the inspection result to the print command determining unit 110 and the time lapse determining unit 120.

The predetermined temperature is previously set by the fuser assembly temperature inspection unit 100 and a high temperature at which the fuser assembly may be deformed.

The print command determining unit 110 determines whether there is a print command in response to the inspection result from the fuser assembly temperature inspection unit 100 and outputs the determination result to the print sheet convey processing unit 130 and the printing unit 150. If the print command determining unit 110 receives the inspection result indicating that the temperature of the fuser assembly is higher than the predetermined temperature from the fuser assembly temperature inspection unit 100, the print command determining unit 110 determines whether there is a print command for a printing from a user.

The time lapse determining unit 120 determines if a predetermined time lapses in response to the inspection result from the fuser assembly temperature inspection unit 100 and outputs the determination result back to the fuser assembly temperature inspection unit 100. If the time lapse determining unit 120 receives the determination result from the fuser assembly temperature inspection unit 100 indicating that the temperature of the fuser assembly is lower than the predetermined temperature, the time lapse determining unit 120 determines whether the predetermined time lapses after the inspection of the fuser assembly temperature inspection unit 100.

The print sheet convey processing unit 130 conveys the print sheet to a predetermined location after passing the print sheet through the fuser assembly in response to the determination result from the print command determining unit 110. The predetermined location may be a sheet-feeding cassette or a sheet-feeding standby location for a back-side printing in a duplex printing mode. The sheet-feeding standby location for a back-side printing in a duplex printing mode is a location where the print sheet stands by for a back-side printing according to a duplex printing process.

Therefore, when the print sheet convey processing unit 130 receives the determination result from the print command determining unit 110 indicating that there is no print command, the print sheet convey processing unit 130 passes the print sheet through the fuser assembly to lower the temperature and then conveys the print sheet to the sheet-feeding cassette or to the sheet-feeding standby location for a back-side printing in a duplex printing mode.

When the overheating preventive operation information storing unit 140 receives a result from the print sheet convey processing unit 130 indicating that the print sheet has been conveyed to the predetermined location, the overheating preventive operation information storing unit 140 stores information indicating that the overheating preventive operation has been performed by passing the print sheet through the fuser assembly. The stored result is output to the fuser assembly temperature inspection unit 100. According to a conventional apparatus, if the print sheet is not discharged outside the image forming apparatus after passing through the fuser assembly, the image forming apparatus recognizes it as a paper jamming and displays an error message. According to an exemplary embodiment of the present invention, to prevent such an error message from being displayed, the overheating preventive operation information storing unit 140 stores information indicating that the overheating preventive operation has been performed by passing the print sheet through the fuser assembly to lower the temperature.

When the printing unit 150 receives the determination result 110 from the print command determining unit indicating that there is a print command for a printing, the printing unit 150 performs a printing according to the print command and outputs the result to the fuser assembly temperature inspection unit 100.

When the fuser assembly temperature inspection unit 100 receives the result stored in the overheating preventive operation information storing unit 140 or the result from the printing unit 150, the fuser assembly temperature inspection unit 100 inspects whether the temperature of the fuser assembly is higher than the predetermined temperature again. The inspection result is output to the print command determining unit 110 and the time lapse determining unit 120.

Preferably, the aforementioned operation of the apparatus for preventing overheating of a fuser assembly is initiated right after finishing the printing. By initiating the operation of preventing overheating of a fuser assembly after finishing a printing, deformation caused by the overheating of the fuser assembly may be automatically prevented.

While a method of preventing overheating of a fuser assembly and an apparatus using the same according to an exemplary embodiment of the present invention has been particularly shown and described with reference to exemplary embodiments thereof, it will be understood by those of ordinary skill in the art that various changes in form and details may be made therein without departing from the spirit and scope of the present invention as defined by the following claims.

As was described above, a method of preventing overheating of a fuser assembly according to exemplary embodiments of the present invention and an apparatus using the same provides advantages in that deformation of the fuser assembly caused by an abnormal high temperature may be prevented. The high temperature of the fuser assembly is lowered by passing a print sheet through the fuser assembly to allow the print paper to take the heat away from the fuser assembly when it is detected that the temperature of the fuser assembly is higher than a predetermined temperature.

What is claimed is:

1. A method of preventing overheating of a fuser assembly, comprising the steps of inspecting whether a temperature of a fuser assembly is higher than a predetermined temperature;

determining whether there is a print command if the temperature of the fuser assembly is higher than the predetermined temperature;

passing a print sheet through the fuser assembly, conveying the print sheet to a predetermined location, and returning to the inspection of the temperature step, if there is no print command;

determining whether a predetermined time lapses if the temperature is lower than the predetermined temperature; and returning to the inspecting step if the predetermined time does not lapse.

2. The method according to claim 1, wherein the predetermined temperature corresponds to a high temperature at which the fuser assembly may be deformed.

3. The method according to claim 1, wherein the determining whether there is a print command further comprises performing a printing if there is a print command and then returning to the inspection of the temperature step.

4. The method according to claim 1, wherein the print sheet that has passed through the fuser assembly to lower the temperature is conveyed to a sheet-feeding cassette as the predetermined location.

5. The method according to claim 1, wherein the print sheet that has passed through the fuser assembly to lower the temperature is conveyed to a sheet-feeding standby location for a back-side printing in a duplex mode as the predetermined location.

6. The method according to claim 1, further comprising storing overheating preventive operation information indicating that the print sheet has passed through the fuser assembly to lower the temperature after passing the print sheet through the fuser assembly.

7. The method according to claim 6, further comprising returning to the inspecting step after the storing the overheating preventive operation information.

8. The method according to claim 6, wherein the following steps are performed right after finishing a substantial printing of the print sheet inspecting whether a temperature of a fuser assembly is higher than a predetermined temperature;

determining whether there is a print command if the temperature of the fuser assembly is higher than the predetermined temperature;

passing a print sheet through the fuser assembly, conveying the print sheet to a predetermined location, and returning to the inspection of the temperature step, if there is no print command;

determining whether a predetermined time lapses if the temperature is lower than the predetermined temperature;

returning to the inspecting step if the predetermined time does not lapse and;

storing overheating preventive operation information indicating that the print sheet has passed through the fuser assembly to lower the temperature after passing the print sheet through the fuser assembly.

9. An apparatus for preventing overheating of a fuser assembly, comprising:

a fuser assembly temperature inspection unit for inspecting a temperature of the fuser assembly to determine if the temperature of the fuser assembly is higher than a predetermined temperature;

a print command determining unit for determining whether there is a print command in response to an inspection result from the fuser assembly temperature inspection unit;

a print sheet convey processing unit for passing the print sheet through the fuser assembly in response to a determination result, which represents that there is no print command, from the print command determining unit, the print sheet being conveyed to a predetermined location in response to the determination result from the print command determining unit;

a time lapse determining unit for determining whether a predetermined time lapses in response to the inspection result from the fuser assembly temperature inspection unit.

10. The apparatus according to claim 9, wherein the predetermined temperature corresponds to a high temperature at which the fuser assembly may be deformed.

11. The apparatus according to claim 9, further comprising a printing unit for performing a substantial printing according to the print command in response to the determination result from the print command determining unit.

12. The apparatus according to claim 9, wherein the print sheet convey processing unit conveys the print sheet that has passed through the fuser assembly to lower the temperature to a sheet-feeding cassette as the predetermined location.

13. The apparatus according to claim 9, wherein the print sheet convey processing unit conveys the print sheet that has passed through the fuser assembly to lower the temperature to a sheet-feeding standby location for a back-side printing in a duplex printing mode as the predetermined location.

14. The apparatus according to claim 9, further comprising an overheating preventive operation information storing unit for storing overheating preventive operation information indicating that an overheating preventive operation has been performed by passing the print sheet through the fuser assembly to lower the temperature.

15. The apparatus according to claim 9, wherein operation of the apparatus is initiated right after finishing a substantial printing of the print sheet.

16. A method of preventing overheating of a fuser assembly, comprising:

inspecting whether a temperature of a fuser assembly is higher than a predetermined temperature;

conveying a print sheet if the temperature of the fuser assembly is higher than the predetermined temperature when there is no print command;

passing the print sheet through the fuser assembly;

reducing the temperature of the fuser assembly; and storing information indicating that the print sheet passed through the fuser assembly to reduce the temperature of the fuser assembly.

* * * * *